United States Patent [19]

Cook

[11] Patent Number: 4,961,307

[45] Date of Patent: Oct. 9, 1990

[54] TEXTILE PROCESSING EMPLOYING A STRETCHING TECHNIQUE

[76] Inventor: Paul P. Cook, 515 Exeter, Unit A-6, San Antonio, Tex. 78209

[21] Appl. No.: 390,947

[22] Filed: Aug. 9, 1989

[51] Int. Cl.[5] ..... D01H 13/12; D01H 5/28

[52] U.S. Cl. ..... 57/310; 57/330; 57/335

[58] Field of Search ..... 57/330, 318, 328, 329, 57/335, 310

[56] References Cited

U.S. PATENT DOCUMENTS

| | | | |
|---|---|---|---|
| 1,922,949 | 8/1933 | Harris | 57/330 |
| 1,922,950 | 8/1933 | Harris | 57/330 |
| 2,143,876 | 1/1939 | Harris | 57/330 |
| 2,387,058 | 10/1945 | Cerny | 57/310 |
| 2,608,817 | 9/1952 | Reinicke | 57/318 |
| 2,688,837 | 9/1954 | Hadwich | 57/330 |
| 3,151,438 | 10/1964 | Althof | 57/330 |
| 4,735,041 | 4/1988 | Mallardi et al. | 57/330 X |

*Primary Examiner*—Joseph J. Hail, III

[57] ABSTRACT

This invention provides methods by which any staple fiber or continuous filament fiber can be stretch processed similiar to continuous filament fiber stretch processing methods heretofore used, in that the fiber's internal molecular structure is oriented along the fiber strand axis, except substantially twisting as well as substantial stretching forces are employed. With only the simple continuous and simultaneous application of a single dynamic stretching stress, and a single dynamic twisting force, that is correct and precisely controlled relative to each other and to its input flow rate, every individual fiber is effectively and uniformly stretch processed. Such individual fiber's net strength properties gain and desirable quality characteristics improvement as well as their continuous cross-sectional uniformity are substantially enhanced for their greater utility, as are fabrics and other products produced from such treated fiber. This invention has been used to increase the tensile strength of cotton to more than 60 grams per tex ($\frac{1}{8}$ gauge) through simple dry mechanical fiber stretch processing. There are substantial advantages available through the use of this high tenacity cotton fiber. Other staple fiber can be similarly improved. The methods of this invention can substantially improve the stretch processing uniformity of continuous filament fiber and hold its substantial original extruded evenness allowing multiple series treatments providing substantially improved stretch processing effectiveness and uniformity. This invention lends itself well to integration into normal production processes.

4 Claims, 2 Drawing Sheets

TEXTILE PROCESSING EMPLOYING A STRETCHING TECHNIQUE

BACKGROUND OF THE INVENTION

1. Field of the Invention

This invention relates to methods of stretch treating every individual fiber of any type of staple fiber or any type of continuous filament fiber, natural or man-made, that is in a strand or strands of substantial uniform thickness. By substantially stretching while simultaneously substantially twisting every individual fiber in such strand or strands in precisely the correct relative amounts. Whereby, such individual fiber's net strength properties gain, and other desireable quality characteristics improvement, as well as their individual fiber and output strand or strands continuous cross-sectional uniformity, are substantially enhanced for their greater utility, as are fabrics and other products produced from such treated fiber.

All the individual fiber within such strand or strands are inherently and effectively captured and stretch processed such that few if any of such fiber can escape effective and uniform treatment. This is achieved with only the simple continuous and simultaneous application of a single dynamic but substantial stretching stress, and a single dynamic but substantial twisting force in precisely the correct relative amounts. The representative devices described herein for an explanation of the present invention's methods' individual fiber stretch processing treatments are relatively simple to explain. However, the explanation of occurrences within such strand or strands, and in particular within each individual fiber, is complex.

When a multiplicity of fiber are being effectively and uniformly stretch processed, each individual fiber within such strand or strands is subjected to substantial torquing, compressing, and stretching forces. Such forces are dynamically transmitted through every individual fiber from one of its ends to its other (staple), or from one stretching point to the other (continuous filament). And, simultaneously transmitted from every individual fiber to its adjacent fiber with which it is in contact, through precisely controlled induced cohesion between them, derived from each of their surface frictional characteristics and compressed contacts. Then, with the prevention of the fiber strand or strands drafting to the maximum practical extent, by generating precisely the correct substantial amount of induced cohesion that is required, every individual fiber is effectively and uniformly stretch processed, rather than being drafted. The individual fibers are stretch processed, but the fiber strand or strands are essentially not drafted. Every individual fiber's internal molecular structure is oriented in the direction of its fiber axis for its substantial strength properties gain, and its desirable quality characteristics improvement.

It is imperative that such fiber in such strand or strands be simultaneously stretched and twisted in precisely the correct relative amounts, to the extent that is practical. If the ratio of twist to stretch is too great (too much induced fiber cohesion) there is too little fiber creep or fiber length increase take-up allowed, and most effective and uniform fiber stretch processing is prevented. If such ratio is too small (too little induced fiber cohesion) there is too much fiber slippage or drafting allowed, and ineffective and irregular fiber stretch processing results.

The substantial stretching against twist treating of any type of staple fiber in precisely the correct amounts using the present invention methods almost entirely prevents its drafting. The primary purpose of the present invention is maximum effective and uniform stretch processing of every individual fiber and not desirable drafting of the strand or strands. The pulling forces are concentrated on stretching the individual fiber while taking up their increase in length and prevented from being wasted in their drafting. Desirable drafting against twist deters effective stretch processing, as substantial stretching against twist of the present invention methods deters desirable drafting.

Maximum effective stretch processing of individual fiber requires relatively, compared to desirable drafting against twist, a substantial amount of stretching stress to just barely overcome the simultaneously applied substantial compressive induced cohesion resistance of the twisting treatment. The stretching forces must just barely overcome the induced cohesion for just the right amount of increased fiber length take-up, without their substantial breakage.

In normal drafting against twist processing of staple fiber where the goal is for maximum effective and uniform drafting of the strand or strands of fiber, and not its individual fiber's effective and uniform stretch processing, a relatively small amount of pulling or drafting force and a relatively small amount of simultaneous twisting is required. The resulting effect is relatively little individual staple fiber resistance to its being pulled or drafted along, among and by its adjoining fibers, but just enough resistance due to the relatively little twist injected for controlled fiber distribution with its adequate slippage. In drafting against twist processing the individual staple fibers are subjected to relatively little or no stretching force, but to small frictional slipping forces along the entire length of every individual staple fiber. Therefore, very little if any measurable effective or uniform individual stretch processing is achieved. Existing drafting against twist art methods are used for maximum effective and uniform desirable drafting of the strand or strands of staple fiber, not the stretching of its individual fibers.

Continuous filament fiber consist of individual fiber that is continuous in its length, so it does not lend itself to drafting or drafting against twist. However, continuous filament fiber has been discovered to be compatible with these present invention methods of stretching against twist for its maximum effective stretch processing in the absence of drafting. Similar to staple fiber using these present invention methods, the pulling stress is concentrated on stretching continuous filament fiber while taking up their increase in length and preventing substantial breakage of individual continuous filament fiber due to excessive take up.

Maximum effective and uniform stretch processing of continuous filament fiber using the present invention methods also requires relatively a substantial amount of stretching stress to just barely overcome the simultaneously generated compressive induced cohesion resistance of its relatively substantial twisting treatment without substantial fiber breakage. These present invention methods substantially improves the uniformity of such filament fiber stretch processing throughout its continuous length as compared with other continuous filament fiber stretch processing methods that do not fully utilize the stretching against twist method as herein provided.

It is known that the strength properties and utility of most substantially uniform filament fibers of continuous length can be improved by first subjecting the initially extruded fiber to a stretching process in which its internal structure molecules are oriented in the direction of its filament axis. Such stretched filament fiber using heretofore available stretching processes often show irregular fluctuations in thickness or its cross-sectional area throughout its continuous length. The thicker portions of the filament having been stretched to a lesser degree than the thinner portions, results in irregularities in its count (weight per unit length) throughout its length. Such irregularities and loss of its original uniformity is further aggravated as the degree of stretching is increased, or a plurality of stretchings are attempted.

Woven or knitted fabrics produced from such filament fiber show unevenness in the weave or stitch construction. Since moreover the portions stretched to a lesser degree absorb a lesser quantity of dye when such woven or knitted fabrics are dyed than the portions which are more highly stretched, the textiles thus obtained are often unsuitable for use.

Besides these defects, crimping phenomena are found in such stretched filament fiber when subsequently subjected to shrinkage processing, where adjacent capillary filaments at the same portion of such filament also have a different degree of shrinkage due to the different degree of stretching. This causes the capillary filaments which shrink to a higher degree in the shrinkage process to displace those capillary filaments which shrink to a lesser degree, whereby a shrinkage crimped fiber with looped capillary filaments is obtained. This may be of advantage for specific use, but in general such a shrinkage processed filament fiber is required to have a smooth surface.

The present invention methods essentially prevents these defects and irregularities, and allows the retention of the filament fiber's original input substantial uniformity. In operation the present invention methods' twisting and stretching forces are evenly distributed throughout every filament or capillary filament fiber and each of its internal molecular structures. Simultaneously it evenly transmits such forces from every filament or capillary filament fiber to all of its other adjacent such fiber with which it is in compressed cohesive contact where multiple fiber strands are being simultaneously processed.

The present invention methods use substantially improve filament fiber (including natural filament fiber like silk) stretch processing uniformity throughout its continuous length, while simultaneously improving their stretch processing effectiveness (as can be done with man-made staple fiber as well as natural) where such fiber has remaining stretch processing improvement potential that has not been fully utilized through previous stretch processing.

Series multiple stretching of filament fiber using the present invention offers substantial improvement in their maximum strength properties (due to using series incremental treating rather than single total treating) while at least retaining their original input substantial uniformity. This has not been practical heretofore since it is physically more difficult to accomplish series multiple stretching utilizing heretofore available filament fiber stretch processing methods and devices. The primary limitation in utilizing such heretofore available stretch processing methods and devices for series multiple stretchings is that multiple treating has heretofore inherently aggravated unevenness and generated unacceptable irregularities in count, dyeing, and shrink crimping uniformity, with substantial loss of the input fiber's original substantial uniformity.

Fiber strength properties are similar to metal wire strength properties in that when either are dry ambient stretched beyond their elastic limit or yield point, but not to their rupture or ultimate strength point, they can never return to their original shape or dimensions and are changed to another configuration when the stretching stress is removed, even though they will spring back somewhat from their fully deformed state. When this is done, both their yield point and rupture point advances to a higher level of stretching stress value in relation to their original level, and such points advance in relation to the degree of stretching to which they have been subjected.

When a subsequent or successive dry ambient stretch processing treatment of such prior treated fiber or metal wire is imposed on either of them, beyond their new yield point but less than their new rupture point, both there yield point and rupture point are again advanced to a higher level. As long as the rupture point is not reached, several multiple or successive dry ambient stretchings of such fiber or metal wire are possible, until finally their rupture point cannot be advanced any more without rupture, thereby substantially improving their strength properties and other desireable quality characteristics. The smaller the incremental advancement of these points with smaller amounts of stretching stress, and correspondingly the more multiple or successive treatments, the higher such advancement can be achieved for maximum results. However, there is a practical limit to the number of incremental treatments that can be imposed. The time required and cost incurred can exceed the stretch processing improvements value gained.

The number of ambient metal wire multiple stretch processing treatments normally utilized is dependent on the kind and alloy being stretch processed, and may vary normally from 4 to 12. The wide variations of all types of fiber in their composition and characteristics also cause a wide variation in the optimum number of multiple or successive stretch processing treatments that should be utilized.

In effectively and uniformly stretch processing any type of fiber utilizing any method, there are four primary factors that must be taken into consideration to achieve maximum practical effectiveness and uniformity.

First, every individual fiber regardless of its length must be stretched uniformly throughout its entire length to the maximum practical extent. In the treatment of staple fiber every individual fiber must be stretch processed from one of its ends to its other, while continuous filament fiber must be stretch processed from one of its chosen stretching points to its other.

Second, the correct duration of continuously applied stretching stress during each fiber's stretch processing treatment provides substantially more effective and uniform individual fiber stretch processing, than quick tugs of short duration.

Third, continuous series or discontinuous individual multiple stretch processing treatments provides substantially more effective and uniform individual fiber stretch processing, than single stretch processing treatment.

Fourth, the correct stress relaxation time between multiple stretch processing treatments provides substantially more effective and uniform individual fiber stretch processing, than no stress relaxation between such treatments.

2. Description of the Related Art

An analysis of drafting against twist processing patents has been conducted in search of prior art pertaining to this present invention, i.e.; Millardi et al U.S. Pat. No. 4,735,041 4/1988; Althof U.S. Pat. No. 3,151,438 10/1964; Hadwich U.S. Pat. No. 2,688,837 9/1954; Reinicke U.S. Pat. No. 2,608,817 9/1952; Harris U.S. Pat. No. 2,143,876 1/1939; Harris U.S. Pat. No. 1,922,950 8/1933; Harris U.S. Pat. No. 1,922,949 8/1933. Each of these patent's specifications refers many times to the drafting of a strand or strands of staple fiber, but never to the physical stretching of any individual staple or continuous filament fiber. If desirable drafting occurs during such processing, effective stretch processing is prevented. The embodiment devices related in these patents are incapable of using, withstanding or transmitting the substantial fiber stretching and simultaneously applied twisting forces that are required for maximum effective and uniform stretching against twist processing of the present invention methods of any type of staple or continuous filament fiber. It apparently was not obvious to these or any others skilled in the art, that a stronger and more durable twisting device could be used for converting the drafting against twist processing to that of stretching against twist.

Drafting against twist processing of staple fiber has been used to produce textiles perhaps for over 5,000 years, but apparently has always been used for effective desirable drafting and never considered for conversion into effective and uniform stretch processing of individual fiber. Stretching against twist processing of any fiber, staple or continuous filament, natural or man-made, as used by the present invention methods is apparently unique in the art to which its subject matter pertains, and its discovery has substantial commercial potential.

Most continuous filament fiber produced is stretch processed by at least one patented method to improve its strength properties, although the uniformity of such filament fiber stretch processing throughout its continuous length is not as good as desired. Many patents were found pertaining to the stretch processing of such fiber between two stretching points. However, none were found that substantially stretches every individual filament fiber while simultaneously substantially twisting every strand or strands in precisely the correct relative amounts, substantially to improve the uniformity of such filament fiber stretch processing treatment throughout its continuous length, as can be accomplished through the use of the present invention methods.

Apparently, for probably over 5,000 years no such thought or reasoning regarding effectively stretch processing any individual staple or continuous filament fiber against twist for its improvement occurred to anyone. There is no evidence known to the applicant of any achievement of effective stretch processing of any individual fiber against twist prior to this present invention. Not only is there apparently no directly applicable prior art, but the new art of this present invention is not commonly or widely known, if it is known at all, in the textile, or any other, field of activity. The differences between the subject matter sought here to be patented and the somewhat related prior art are such that the subject matter as a whole apparently was not obvious, at the time any prior invention was made, to any person having ordinary skill in the art to which said subject matter pertains. Such prior inventors or those skilled in the art were apparently totally engrossed with the subject matter of desirable drafting of a strand or strands of fibers and not their obscure individual fiber stretch processing, or conversion potentials of drafting against twist processing to that of stretching against twist. Their application devices were apparently never intended for the rugged applications of effective and uniform stretching against twist processing of individual fiber of the present invention.

In search of prior art pertaining to this present invention, other than drafting against twist (7 related patents discussed above) and filament fiber stretch processing methods, the only patent that could be found that relates to the physical stretching of individual staple fiber is; Cerny U.S. Pat. No. 2,387,058 10/1945; "Treatment of Cotton Fibers"; patent classification 57-310 Textiles, Spinning, Twisting and Twining—Apparatus and Process; with stretching. This method specifically rejects any twisting of the staple fibers, and specifically stipulates that the processed bundle or strand of cotton staple fibers be prestressed with the distance between its two stretching points set less than the length of the cotton fibers, to stretch the individual cotton fibers without breaking them. The present invention methods require substantial stretching while simultaneously substantially twisting every individual staple fiber in precisely the correct relative amounts, with the distance between its two stretching points more (rather than less) than the length of any staple fiber being processed without substantial breakage.

A thorough analysis of U.S. Pat. No. 2,387,058 Oct. 1945 Cerny was conducted to determine if it contains prior art pertaining to this present invention. To analyze its relative effectiveness in relation to the present invention's effectiveness in stretch processing every individual cotton staple fiber from one of its ends to its other, a standard representative lot of cotton staple fiber to be analyzed as being processed by both methods was first defined.

In summary, this cotton staple fiber stretching method, as described in the published patent document, uses steel grips to stretch small fiber bundles that contained about 1575 parallel fibers and weigh 5 mg., and were carefully cut to be ¾ inch in length. Such test bundles were cut from cotton having a 1⅛ inch standard class stock staple length that had been carded, drawn and combed. The cut bundles were carefully cleaned and hand combed to remove foreign material and to arrange the fibers in an untwisted parallel relation. Such bundles were prepared after and during standard atmosphere conditions exposure. These test bundles were mounted vertically in steel grips with a distance between grips being 3/16 inch making sure that every individual fiber was firmly gripped to prevent any slippage.

Six sets of tests were conducted using the carefully prepared test bundles, and excellent unquestionable test data was obtained. Unfortunately these test results relate only to the 3/16 inch length of cotton fiber that was carefully prepared and fixed between two steel grips. The remainder of the individual cotton fibers that originated from 1⅛ inch standard classed stock was either cut away from the carefully prepared bundles or was subjected to the compressive pressure of the steel grips, neither fiber segments of which was stretch processed at all, or entered into the test results. The 3/16 inch cotton fiber length that was treated remained fixed in its steel grips while it was subsequently tested.

None of the 3/16 inch treated fibers were said to have been cut from between the steel grips and used in any way to produce effectively stretch processed yarn or fabric or any other textile product to determine the useability of such 100% effectively stretch process treated cotton staple fiber. Likewise there were no 1⅛ inch standard class stock staple fibers said to be fixed in these steel grips allowing 3/16 inch of their length to be effectively stretch processed and then released from its steel grips in its full length to then be processed into yarn or fabric or any other textile product to determine the useability of such staple fiber that was only 3/16 inch treated (about 16% effectively stretch processed) fiber. However, the results of these six sets of stretch processing tests on only 3/16 inch of the individual cotton staple fibers that were tested, probably represents what might be expected if the entire length of all such individual fibers were stretch processed according to the tests but throughout each of their entire length.

Similar laboratory test to these have been conducted for over 50 years in many areas of the world with similar results. Recently extensive testing was conducted to determine the useability potential of the present invention method of stretch processing any fiber, including cotton. Here the stretch processed cotton staple fiber test results closely correspond to the test results of the above related six sets of cotton staple fiber stretch process testing.

After over 50 years of such testing it is conclusive that any fiber, natural or man-made, can be substantially improved through its appropriate stretch processing. Man-made continuous filament fiber stretch processing methods and devices have been developed and patented, but with their remaining difficulty of providing uniformity of such filament fiber stretch processing throughout its continuous length. Throughout this half century the necessity of effectively stretch processing natural staple fiber to fully utilize its known potential of substantial improvement has challenged many possible inventors. U.S. Pat. No. 2,387,058 Oct/1945 Cerny was apparently the only one successful in obtaining a methods patent for Treatment of Cotton Fiber.

One of Cerny's patented methods comprises arranging a multiplicity of untwisted cotton fibers in a substantially parallel relation, gripping each of the ends of the individual fibers with force sufficient to prevent slippage when tension is applied thereto, applying tension to the individual fibers sufficient substantially to stretch the individual fibers without effecting breakage thereof while the individual fibers are so gripped and without slippage of the fibers from their gripped position. It is incomprehensible to the applicant that such a laborious process could ever be seriously considered for a commercial activity.

Another of Cerny's patented methods comprises preparing a sliver of substantially uniform thickness and consisting of a multiplicity of untwisted cotton fiber in substantially parallel relation with the staple fiber stretch processing points being spaced apart a distance less than the length of the cotton fiber in the sliver so the ends of the individual cotton fibers in the sliver are simultaneously gripped with substantially equal forces by the two stretching points substantially to stretch the individual cotton fibers within the sliver without breakage thereof whereby to obtain a sliver of substantially the same thickness as the original sliver. In using Cerny's preferred embodiment of this method, a drawing machine type of cotton staple fiber stretch processing device, its productivity should be greater than using steel grips and carefully prepared fiber bundles, but its productivity is inversely proportional to its desired stress duration time, and its maximum practical output is probably only about 1½ yds/min.

Cotton fiber is available in commercial production quantity only in randomly mixed lengths of individual fibers. For such cotton staple fiber to be arranged in sliver of substantially uniform thickness that is untwisted and in substantially parallel relation utilizing the most practical currently available commercial processing methods and devices, it would have to be carded, drawn and perhaps combed. The randomly mixed lengths of individual fibers in such sliver, to be substantially uniform in thickness, would also have to be randomly distributed along such sliver's processing flow axis. To utilize any of Cerny's patented methods, a staple fiber stretch processing zone between two stretching points must be selected and set to be used that is less than the length of the cotton fibers in such sliver. Any zone distance chosen, 3/16 inch, ⅔ inch or any that is less than the longest fiber being processed, that zone will contain randomly the fiber ends of individual fibers that can not be simultaneously gripped with substantially equal forces by the two stretching points. Therefore, staple fiber stretch processing effectiveness will be reduced.

The thorough analysis of this patent referenced above, clearly shows that in using any staple fiber stretch processing method, every fiber must be effectively stretched from one of its ends to its other for 100% effective stretching. None of the fiber's length can be used for gripping or be outside the gripping points, and the distance between gripping points must be at least as long as every individual fiber being stretched, or the effectiveness of stretch processing such fiber will be correspondingly reduced. Therefore, as long as the staple fiber stretch processing zone is less than the length of the staple fiber being stretch processed, as is required in utilizing Cerny's methods, 100% effective stretch processing is impossible for commercial activity.

This above referenced analysis of Cerny's patented methods also clearly shows that with a single stretch processing treatment passage, only about 54% maximum stretch processing treatment at any production rate is probable, with a maximum desired stress duration time treatment at normal production rate (about 1½ yds/min) of only about 12% is probable. The production rate of Cerny's preferred embodiment is inversely proportional to its stress duration time, so reduced production could increase stress duration time treatment. However, this is inefficient staple fiber stretch processing. Of greater importance, the resulting effectiveness of the stretch processed cotton staple fiber strength properties improvement is probably unacceptable.

Although most of the individual treated staple fibers are stretch process improved for a portion of their length, they are not stretch process improved at all in the remaining portion of their length. Such fiber's overall stress resistance might not be improved at all, since they might break at their weakest point (within its unstretched portion) when subjected to high stress loads that their effectively stretched portion could withstand.

It is impossible (using Cerny's but not the present invention methods) to stretch the staple fibers that are shorter than the stretch processing zone chosen and set for processing such staple fibers. And, the staple fibers that are longer than such zone are only partially stretched (a portion of their length improved in strength properties, and the remaining portions of their length not improved at all). The staple fibers must always be longer than such zone in using the present invention methods, whereby all staple fibers are near 100% effectively stretch processed.

The published document of Cerny's methods patent relates no way by which the results of the six sets of tests described therein can be commercially accomplished as implied using such methods, except 3/16 inch lengths of cotton staple fiber that are not suitable for commercial use.

In contrast, this present invention method of stretch processing any fiber, staple or continuous filament, or natural or man-made, allows for 100% stretch processing treatment in a single stretch processing treatment passage (although multiple series passes will usually provide better results). It does this while simultaneously it also allows for 100% minimum desired stress duration time treatment without reducing maximum practical production rate (over 50 yds/min) or stretch processing uniformity. This production rate is all that is required for integration compatibility with yarn forming methods and devices with the highest practical production rates without compromise. Each fiber, regardless of its individual fiber length, can be stretch processed effectively and uniformly throughout its entire length, from one of its ends to its other (staple fiber), or from one of its stretching points to its other (continuous filament fiber). The stretch processing zone distance only has to be, greater than the longest fiber (staple fiber), and the desired distance to obtain the desired degree of stretch processing uniformity throughout such distance (continuous filament fiber or staple fiber). Desired stress duration time can be obtained without reduction of production or uniformity by merely increasing the distance between stretching points. Stretch processing zone distance can be over 100 inches if desired without compromising fiber stretch processing effectiveness or uniformity.

SUMMARY AND OBJECT OF THE INVENTION

It is an object of the invention to provide methods by which every individual fiber of any type, staple or continuous filament, natural or man-made, that is in a strand or strands of substantial uniform thickness is effectively and uniformly stretch process treated to the greatest advantage possible. Whereby, such individual fiber's net strength properties gain and other desireable quality characteristics improvement as well as its internal molecular structure and output strand or strands stretching uniformity throughout its length is substantially enhanced over its input condition to the maximum practical extent for its greater utility than heretofore achievable. It is also an object of the invention to provide solutions to the deficiencies of previous methods of fiber stretch processing cotton staple and continuous filament.

According to the invention, every individual fiber of any type that is in an input configuration of substantially uniform thickness is effectively and uniformly stretch process treated. Whereby, every such individual fiber is transported within a stretch processing zone between two stretching points, whose distance apart is set at least (1) greater than the longest staple fiber (if applicable), (2) to obtain the minimum stress duration time desired, (3) to obtain the production rate desired allowing such stress duration time, and (4) to obtain the degree of stretch processing uniformity desired throughout such distance. Such fiber is there simultaneously subjected to substantial stretching stress and substantial twisting to generate compressive induced cohesion forces on such fiber for its proper stretching against twist processing in precisely the correct relative amounts (1) to each other, (2) to the input count and (3) as required by the characteristics of such input fiber, and (4) as required to obtain the stretch processing results desired, without substantial fiber breakage. The twist utilized can be with a clock-wise or counter-clock-wise rotation about the processing flow axis.

The stretch processing zone (between the two stretching points) distance can be over 100 inches if desired without compromising fiber stretch processing effectiveness. The greater such distance, the better the output stretch processing uniformity. Such distance can be adjusted to accommodate production rates up to the maximum practical (design speed limit) while accommodating the minimum desired stress duration time without compromising stretch processing uniformity.

A primary feature of novelty of the present invention methods is that every individual fiber regardless of its length is effectively and uniformly stretch processed utilizing the stretching against twist technique, and prevents the drafting against twist technique of the strand or strands to the maximum practical extent. Whereby, precisely controlling induced fiber cohesion and transmitting the stretching forces to their internal molecular structures for their proper treatment therein. The present invention methods are not primarily intended to draft fiber, but to stretch process the internal and external structure of every individual fiber.

Continuous filament fiber stretch processing has been conducted commercially for many years in a similar way in which its internal molecular structures are oriented along their filament axis. However, the uniformity of such filament fiber stretch processing throughout its continuous length is not as good as desired, and because of such deficiency its maximum effectiveness is somewhat compromised. The present invention methods now allows staple fiber to be stretch processed in a similar way to continuous filament fiber on a commercial basis for the first time since mankind began using them, and for continuous filament fiber to be more effectively and uniformly stretch processed.

Essentially, all the natural (non-man-made) fibers which have been thought to have been utilized for their maximum practical strength properties, have not, heretofore, been utilized to their maximum practical and readily available potential. Their individual fiber's stretch processing potentials for their greater utility, have remained dormant, idle, or stored since mankind began using them.

For example, cotton fiber, regardless of its variety or special growing conditions, is rarely found with tensile strength over 40 grams per tex ($\frac{1}{8}$ inch gauge testing). It is usually found in the 20's and 30's grams per tex range. Fiber strength is well known to translate directly into fabric strength, but to a much lesser degree into yarn strength, however substantially improved fabric and its end products through increased fiber strength is the primary goals.

The present invention has been used to increase the tensile strength of cotton to more than 60 grams per tex through simple dry mechanical fiber stretch processing. Slightly improved yarn is produced from such treated fiber, but substantially improved fabrics can now be produced in commercial quantity from it. Dry mechanical stretch processing such fiber does not compromise subsequently used wet processing treatments including thermal, chemical or other finishing treatment improvements. Such dry and wet processing treatments are additive in their improvements, and they are complementary to one another with little or no compromise. The present invention lends itself well to integration into normal yarn production processes. It can be used for both dry and wet processing, but independent dry and wet processing is required to capitalize on the additive improvements of both.

As related previously, for over 50 years laboratory type tests have clearly shown that all types of fiber can be substantially improved through dry mechanical fiber stretch processing. A Belgium researcher concluded in his 1970 published paper entitled, "Stretching As A Method To Improve Cotton Fiber Strength", with these words, "Till now a stretching procedure for fiber stretching does not exist, and it would be worthwhile to consider this problem with the needed attention". This present invention addresses that need.

In conducting exploratory testing to determine the extent of the potentials of the present invention methods, it was found that all fibers tested are not only substantially improved in their strength properties but they are also improved in their other desireable quality characteristics. For example, cotton fiber that was dry mechanically stretch processed using the present invention methods is substantially stronger, stiffer, tougher, and is more elastic and resilient in its strength properties; and, as an unexpected bonus, it is slightly longer, of more uniform length, slightly finer, softer, and brighter, and is more like silk.

Effective and uniform stretch processed fiber of any type produced in using the present invention methods can be used to produce significantly improved fabrics and end products with substantial production cost advantages. For example, a specific quantity and quality of cotton fiber currently used to produce 9 100% cotton sheets can be expected to be used to produce 12 or more such sheets if such fiber is effectively and uniformly stretch processed using the present invention methods before it is made into yarn and fabric in the normal way, and the required changes in such sheeting fabric's construction (fewer ends and picks) and weight per square yard (lighter) are acceptable, as long as the fabric strength requirement remains constant. The reduction of picks and ends per inch would substantially reduce production costs, and the significantly lighter sheet would be much more desirable from many aspects, as long as the fabric strength requirements are met.

With the substantial increase in fiber strength properties of cotton fiber that has been stretch processed using the present invention methods, such fiber can be expected to be used without blending with polyester or other high tenacity fibers to produce easy care fabrics and end products. Cotton fiber that has been effectively and uniformly stretch processed using the methods of the present invention is inherently a high tenacity cotton fiber. Easy care 100% cotton fabrics can now be a practical reality. It can also be expected that with such high tenacity cotton fiber used 100% without blending, mercerizing and other such chemical treatments of fabrics made from it will be substantially stronger after such treatments than could heretofore be obtained. It is expected that high tenacity cotton fiber with a fiber strength of 80 grams per tex ($\frac{1}{8}$ inch gauge) can be produced by using the present invention methods and growing cotton fiber for its specific effective treatment. Cotton could be put in a competitive position with high tenacity man-made fibers.

DESCRIPTION OF THE DRAWINGS

The drawings illustrate use of the two basic processing embodiments, fixed input feed unit and stretch/twist unit, of the present invention in three configurations of plurality or successive individual fiber stretch processing treatments with variable stress relaxation time operations, all of which satisfy the four primary factors that must be taken into consideration to achieve maximum practical effectiveness and uniformity.

DESCRIPTION OF THE PREFERRED EMBODIMENTS

The third primary factor required for maximum effective and uniform fiber stretch processing as presented previously specifies, "Continuous series or discontinuous individual multiple stretch processing treatments provides substantially more effective and uniform individual fiber stretch processing, than single stretch processing treatment." The fourth primary factor specifies, "The correct stress relaxation time between multiple stretch processing treatments provides substantially more effective and uniform individual fiber stretch processing, than no stress relaxation time between such treatments." These two latter primary factors are compelled by the first two (every individual fiber treatment, and stress duration time treatment) to satisfy their requirements through a plurality of successive individual fiber stretch processing treatment variations in the operational use of basic processing embodiments. Whereas, these basic processing embodiments satisfy the prerequisite requirements of the first two primary factors of fiber stretch processing.

All four of these primary factor requirements are satisfied by three types of fiber stretch process treating operations as herein described as embodiments of the present invention methods, and as shown in the accompanying figures. These three types of operations uses only two basic processing embodiments (as illustrated in the accompanying figures), A. the fixed input feed unit (4), and B. the essential stretch/twist unit (6).

These three types of series operations (third primary factor) provide for three variations in stress relaxation time (fourth primary factor) through variations in the operational configuration of these two basic processing embodiments used in a plurality of successive individual fiber stretch processing treatments.

Figure 1:
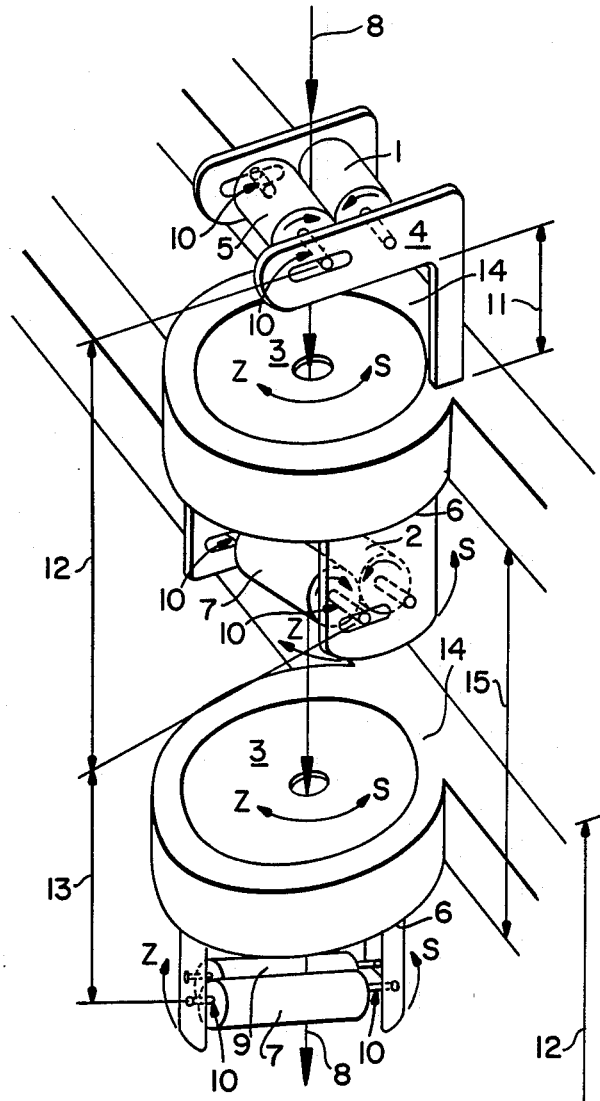
FIG. 1 shows a simplified perspective view of a continuous series multiple embodiment that does not provide for any stress relaxation time.
Figure 2:
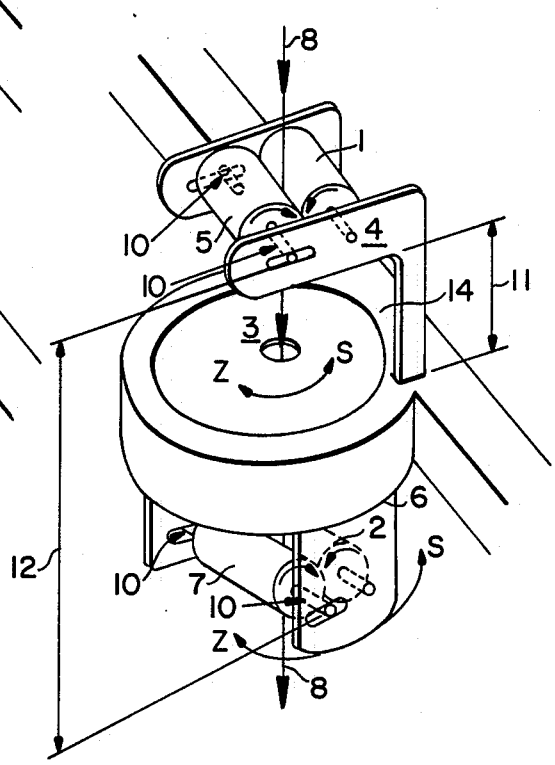
FIG. 2 shows a simplified perspective view of a discontinuous individual multiple embodiment that provides unlimited stress relaxation time (several minutes to several hours or more).
Figure 3:
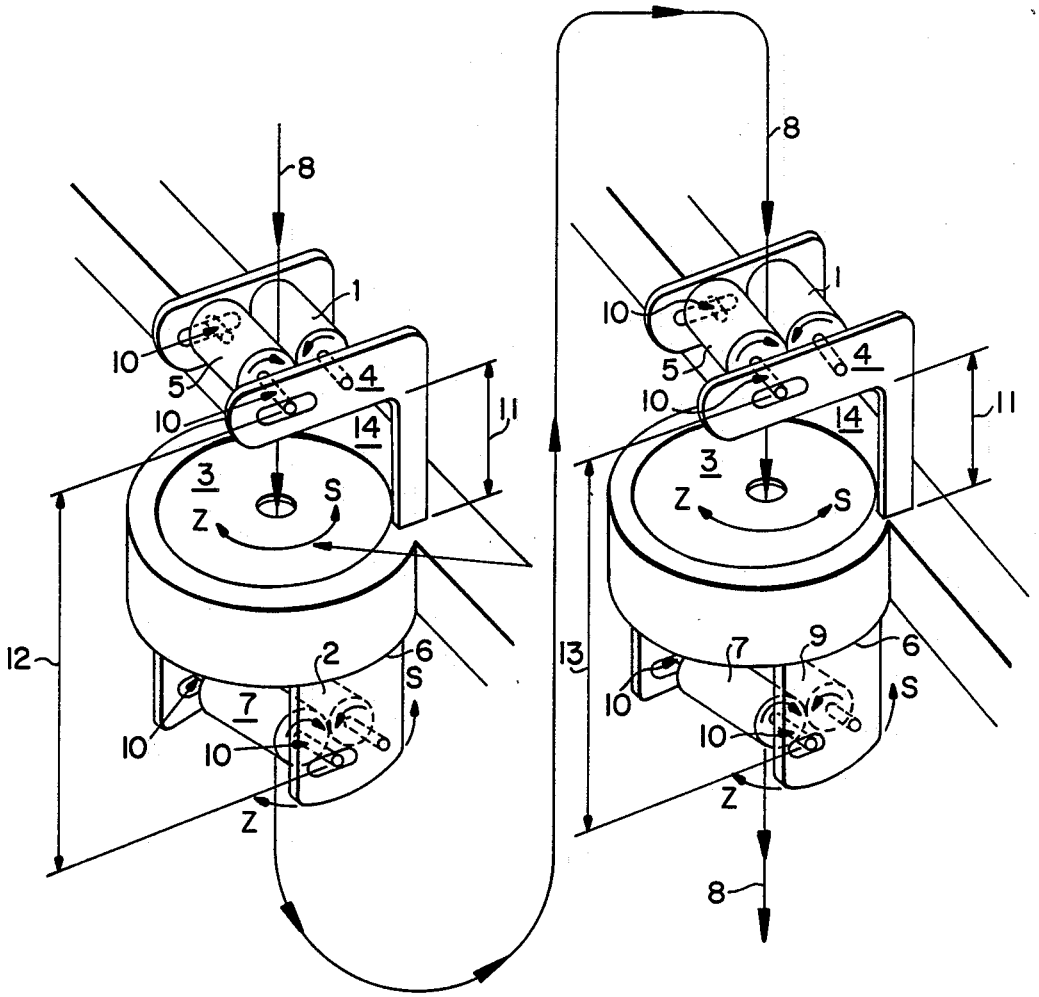
FIG. 3 shows a simplified perspective view of a continuous series multiple embodiment that provides limited stress relaxation time (less second to a few minutes).

The three type of multiple stretch process treating operations that provide variations in stress relaxation time are, A. continuous series multiple, none (NO) (FIG. 1),
B. continuous series multiple, limited (LTD) (FIG. 3), and
C. discontinuous individual multiple unlimited (MAX) (FIG. 2).

Stress relaxation time from none to the maximum practical is thereby provided. This time can be selected, set, and used to the extent desired, or not used, between successive stretch processing zones (Zone). This time can be varied from one stress relaxation time treating area (Area) to another, and in any order desired. The three types of operations can be utilized in any sequential mixture, or order desired.

The flow, stretching, and twisting rates of the driving elements of every fiber stretch processing zone (Zone) must be precisely controlled relative to one another. The input flow rate of the 1st Zone (12) is controlled by the fixed input feed unit (4) driving element's settings. The stretching and twisting rates of the stretch/twist unit (6) are controlled by its driving elements' settings. The specific number of twist turns used per unit length of the continuously fed fiber strand or strands (8), is determined by the product of the square root of the input count (weight per unit length of such strand or strands), and the vital twist multiple selected. This twisting rate, as well as the selected stretching rare, is set for precise control into the driving elements of the stretch/twist unit (6).

The output flow rate of a fiber stretch processing zone (Zone) inherently becomes the input flow rate of any subsequent fiber stretch processing zone (Zone), where continuous multiple stretch processing zones are used. The twisting and stretching rates of any subsequent fiber stretch processing zones (Zone) are set and controlled as described below for the 1st Zone, except that the strand or strands being stretch processed (8) are somewhat decreased in cross-sectional area throughout their length (count change) due to such treatment of prior Zones. The twist multiple and stretching rate chosen and set into the driving elements of every stretch/twist unit (6) can vary from Zone to Zone, in any order desired.

With only the simple continuous and simultaneous application of a single substantial dynamic stretching stress, and a single substantial dynamic twisting force, that are correct and precisely controlled relative to each other and to the input flow rate, every fiber stretch processing zone (Zone) provides effective and uniform fiber stretch process treating.

The fixed input feed unit (4) assembly used in these three types of stretch process treating operations embodiments (FIGS. 1, 2, and 3), as one of the two basic processing embodiments, contains a driving input feed roll (1) and compressing idler roll (5) pair. This fixed assembly can be adjusted up or down (11) parallel to the vertical axis (as used here but not requred to be vertical) of the fiber processing flow path (8). This adjustment (11) is required to set the distance between fiber stretch processing roll pairs (1,5 and 2,7), the fiber stretch processing zone (12), as required. The adjustable compressive force (10) of the compressing idler roll (5) onto the driving input feed roll (1) can be set as desired. This roll pair can have any combination of roll surfaces as desired.

The stretch/twist unit (6) assembly, used as the other basic processing embodiment, contains a twisting device (3)(shaded) with its integral driving output stretching/twisting roll (2) and compressing idler roll (7) pair subassembly. It also consist of a fixed housing assembly (14), as is the fixed input feed unit (4), inside of which the entire integral twisting device (3)(shaded), with its driving output stretching/twisting roll (2) and compressing roll (7) pair subassembly, transversely rotates about the fiber processing flow path (8) as an integrated unit. This entire transversely rotating integrated function subassembly (3,2,7) provides and imparts the precise degree of twist required into the fiber strand or strands (8) being stretch processed. This subassembly also simultaneously provides and imparts the precise degree of fiber stretching stress required, through its driving output stretching/twisting roll (2) and compressing idler roll (7) pair subassembly by rotating at a slightly higher rotational (feeding) speed than its upper stretching pair (1,5). This entire stretch/twist unit assembly (6) can be adjusted up or down (15) parallel to the fiber processing flow path (8), as can the fixed input feed unit (11), where neither is required to be vertical. These adjustments (11,15) are required to set the distance between each of these two fiber stretch processing roll pairs (1,5 and 2,7; and, 2,7 and 9,7), the fiber stretch processing zones (12,13), as required. The twisting device (3)(shaded) and its integral simultaneously imparting stretching/twisting roll pair (2,7) can be transversely rotated in a clock-wise (Z) or a counter clock-wise (S) direction. The adjustable compressive forces (10) of the compressing idler roll (7) on the driving output stretching/twisting roll (2) can be set as desired. The stretching/twisting roll pair (2,7) can have any combination of roll surfaces as desired.

Continuous series multiple—none (FIG. 1):

NO: This stretch process treating operation that provides no stress relaxation time, uses a single fixed input feed unit (F unit)(4), and multiple stretch/twist units (S/T unit)(6).

1st Zone: Process flow sequence: The strand or strands of input fiber (8) are transported into the 1st fiber stretch processing zone (1st Zone)(12) by the fixed input feed unit (F unit)(4). The desired 1st Zone distance (12) set between the (effective working points of the stretching rolls used herewith) input stretching point (of F unit)(1,5) and the output stretching point (of 1st S/T unit)(2,7) defines the 1st Zone (12).

2nd Zone: The output stretching point (of 1st S/T unit)(2,7) of the 1st Zone (12) inherently becomes the input stretching point (of same 1st S/T unit)(2,7) of the 2nd Zone (13), as the fiber being processed (8) is instantly transported from the 1st Zone (12) to the 2nd Zone (13). The desired Zone distance (13) set between this (now) input stretching point (of 1st S/T unit)(2,7) and the output stretching point (of 2nd S/T unit)(9,7) defines the 2nd Zone (13). Any subsequent Zone is likewise defined by the use of any single subsequent S/T unit (6). If a subsequent Zone is not to be used, then the output fiber strand or strands (8) of the 2nd Zone is collected as appropriate for subsequent processing, or fed directly to the next process as appropriate if this fiber stretch processing operation is integrated with a subsequent operation.

Continuous series multiple—limited (FIG. 3):

LTD: This stretch process treating operation that provides limited stress relaxation time (less than a second to a few minutes), uses a F unit(4) and a S/T unit(6) as a tandem pair (4/6) for every Zone/Area (fiber stretch processing zone/stress relaxation time area) tandem pair processing flow space.

1st Zone: Process flow sequence: Here the 1st Zone (12) is defined in the same way as described above for the no stress relaxation time operation (NO: 1st Zone)(12).

1st Area: Then to provide limited stress relaxation time (less than a second to a few minutes) between the 1st Zone (12) and the 2nd Zone (13), a 2nd F unit(4) is used and placed the correct desired distance apart from the 1st S/T unit (6) (not required to be in a straight line of process flow since such strand or strands are relaxing). The output stretching point (of 1st S/T unit)(2,7) of the 1st Zone (12) inherently becomes the input relaxation point (of same 1st S/T unit)(2,7) of the 1st Area (of 16)(from 2,7 to 1,5) as the fiber being processed (8) is instantly transported from the 1st Zone (12) to the 1st Area (16). The desired Area distance (18) set between this (now) input relaxation point (of 1st S/T unit)(2,7) and the output relaxation point (of 2nd F unit)(1,5) defines the 1st Area (16).

2nd Zone: The output relaxation point (of 2nd F unit)(1,5) of the 1st Area (16) inherently becomes the input stretching point (of same 2nd F unit)(1,5) of the 2nd Zone (13) as the fiber being processed (8) is instantly transported from the 1st Area (16) to the 2nd Zone (13). The desired Zone distance (13) set between this (now) input stretching point (of 2nd F unit)(1,5) and the output stretching point (of 2nd S/T unit)(9,7) defines the 2nd Zone (13).

2nd Area: To provide limited stress relaxation time between the 2nd Zone (13) and a 3rd Zones, a 3rd F unit would be used. If a 3rd Zone is not to be used, then the output fiber strand or strands (8) of the 2nd Zone (13) is collected as appropriate for subsequent processing, or fed directly to the next process as appropriate if this fiber stretch processing operation is integrated with a subsequent operation. If a 3rd Zone is to be used, the output stretching point (of 2nd S/T unit)(9,7) of the 2nd Zone (13) inherently becomes the input relaxation point (of same 2nd S/T unit)(9,7) of the 2nd Area (17), as the fiber being processed (8) is instantly transported from the 2nd zone (13) to the 2nd Area (17). The desired Area distance (of 17) set between this (now) input relaxation point (of 2nd S/T unit)(9,7) and the output relaxation point of a 3rd F unit defines the 2nd Area (17). Any subsequent Zone/Area tandem pair processing flow spaces, are likewise defined by the use of any subsequent F unit (4)/S/T unit (6) tandem pair (4/6).

Discontinuous individual multiple—unlimited:

MAX: This stretch process treating operation that provides unlimited stress relaxation time, uses a single F unit (4) and a single S/T unit (6). This operation requires that the output strand or strands of fiber (8) be collected so that they are free for stress relaxation for any length of time desired. This time can be from several minutes to several hours or more between subsequent discontinuous individual multiple stretch process treating operations, or any other subsequent operation.

1st Zone: Process flow sequence: Here the 1st Zone (12) is defined in the same way as described above for the 1st Zone NO (12) or 1st Zone LTD (12) stress relaxation time operations. Any subsequent MAX type of fiber stretch processing zone is likewise defined by the use of any subsequent single F unit (4) and a single S/T unit (6).

A simplified summary of all of the preferred embodiments description above is as follows:

The present invention methods are surprisingly easy to translate into devices that are simple to operate effectively and efficiently. Operations require only the placing of an F unit apart from a rugged S/T unit, and setting a stretching speed constant and twisting speed constant in relation to the F unit's speed for its effective and uniform stretch process treating of any type of fiber. That is all that is required unless maximum practical results are desired.

If maximum practical results are desired, series processing is required. The type and characteristics of the fiber to be stretch processed, and the desired results then dictates using specifically one of three series processing configurations as described above.

These three types of stretch processing operations embodiments of the present invention methods are simply three configurations or use options of two basic processing embodiments, fixed input feed unit and stretch/twist unit. Operational choices of stress relaxation time from none to the maximum practical is required for stretch processing any fiber. All fiber has a wide fiber characteristics variability, as does potential desired stretch processing results, both of which determine the stress relaxation time required to be used. Therefore, it is preferred that these two basic processing embodiments be available in adequate numbers so that they can be assembled in desired configurations as they are needed. Fixed stretch process operations embodiment configurations are less desirable. Thus, such configuration variability is the preferred embodiment of the present invention methods.

While specific embodiments and processing variations of the present invention methods have been described and illustrated in some detail to relate the application of their principles, it will be understood that the invention may be embodied otherwise and different modifications and equipment procedures evident to those skilled in the art may be applied without departing from such principles.

I claim:

1. The method of stretch treating every individual fiber of any type that is in an input configuration of substantial uniform thickness, said method comprising the steps of:

a. providing a means of feeding such input fiber at a desired input feed rate into a fiber stretch processing zone, b. providing a fiber stretch processing zone between two stretching points, c. adjusting such stretching points a distance apart and setting them at least greater than the longest staple fiber, to obtain the minimum stress duration time desired, to obtain the production rate desired allowing such stress duration time, and to obtain the degree of stretch processing uniformity desired throughout such distance, d. providing a means of twisting such input fiber within such fiber stretch processing zone at the desired twisting rate relative to the input flow rate so as to virtually prohibit relative slippage or drafting of the individual fibers relative to one another, e. providing a means of simultaneously stretching such input fiber within such fiber stretch processing zone at the desired stretching rate relative to the input flow rate, to subject every such individual fiber simultaneously to substantial twisting and substantial stretching for precisely correct stretching against twist processing in the required relative amounts to each other and to the input count, as required by the characteristics of such input fiber to obtain the stretch processing results desired, without substantial breakage of the fibers, whereby such input fiber's net strength properties are increased and every individual fiber molecular structure is altered and improved and wherein the uniformity of the output fibers is also improved throughout their length.

2. The method of stretch treating as set forth in claim 1, whereby such method is used in a plurality of successive individual fiber stretch processing treatments, said method comprising the steps of:

f. providing a means of taking-up the output fiber of the prior fiber stretch processing zone and feeding it to a subsequent fiber stretch processing zone at a desired processing flow rate through a stress relaxation time area for limited stress relaxation time of such individual fiber's prior stretch processing zone treatment, thereby providing for continuous subsequent stretch processing of such fiber, g. providing a stress relaxation time area between the output point of the prior fiber stretch processing zone and the input point of the subsequent fiber stretch processing zone, h. adjusting such output and input points a distance apart and setting their respective speeds to obtain the minimum desired but limited stress relaxation time, and to obtain the desired production rate allowing such stress relaxation time, for releasing of stress applied, to every such individual fiber by such stretch treating as set forth in steps a through e, between successive applications of such method.

3. The method of stretch treating as set forth in claim 1, whereby such method is used in a plurality of successive individual fiber stretch processing treatments, said method comprising the step of:

f. providing a means of taking-up and temporarily storing the output fiber of the prior fiber stretch processing zone for unlimited stress relaxation time of such individual fiber's prior stretch processing zone treatment before any subsequent processing of such fiber, for unlimited releasing of stress applied, to every such individual fiber by such stretch treating as set forth in steps a through e, between successive applications of such method.

4. The method of stretch treating as set forth in claim 1, whereby such method is used in a plurality of successive individual fiber stretch processing treatments, said method comprising the steps of:

f. providing continuous series stretch treating as set forth in steps a through e, whereby no stress relaxation time of such individual fiber's prior stretch processing zone treatment is provided in which the output point of the prior fiber stretch processing zone is also simultaneously used as the input point of the subsequent fiber stretch processing zone, thereby inherently serving as the input feeding means for the subsequent fiber stretch processing zone, whereafter such subsequent zone's stretch treating as set forth in steps b through e is continued to its completion, for continuous series stretch treating with no releasing of the stress applied, to every individual fiber by such stretch treating as set forth in steps a through e, between successive applications of such method.

* * * * *

UNITED STATES PATENT AND TRADEMARK OFFICE

CERTIFICATE OF CORRECTION

PATENT NO. : 4,961,307

DATE : October 9, 1990

INVENTOR(S) : Paul P. Cook

It is certified that error appears in the above-identified patent and that said Letters Patent is hereby corrected as shown below:

Column 17, lines 11 and 12, should read-- fiber,
to obtain the stretch processing results desired,--.

Signed and Sealed this

Ninth Day of November, 1993

*Attest:*

*Attesting Officer*

BRUCE LEHMAN

*Commissioner of Patents and Trademarks*